US007845398B2

(12) United States Patent
Wood

(10) Patent No.: US 7,845,398 B2
(45) Date of Patent: Dec. 7, 2010

(54) APPARATUS FOR PERFORMING EARTH BOREHOLE OPERATIONS

(75) Inventor: Thomas Dyer Wood, Calgary (CA)

(73) Assignee: Coil Tubing Technologies, LLC, Casper, WY (US)

( * ) Notice: Subject to any disclaimer, the term of this patent is extended or adjusted under 35 U.S.C. 154(b) by 442 days.

(21) Appl. No.: 11/149,673

(22) Filed: Jun. 10, 2005

(65) Prior Publication Data

US 2006/0231267 A1 Oct. 19, 2006

Related U.S. Application Data

(63) Continuation-in-part of application No. 11/107,183, filed on Apr. 15, 2005, now abandoned.

(51) Int. Cl.
*E21B 19/22* (2006.01)

(52) U.S. Cl. ..... 166/77.2; 175/162

(58) Field of Classification Search ..... 166/377, 166/380, 384, 77.2, 77.51; 175/122, 162
See application file for complete search history.

(56) References Cited

U.S. PATENT DOCUMENTS

| | | | | |
|---|---|---|---|---|
| 3,734,210 | A | 5/1973 | Wilderman | |
| 4,515,220 | A | 5/1985 | Sizer et al. | |
| 4,655,291 | A | 4/1987 | Cox | |
| 5,244,046 | A | 9/1993 | Council et al. | |
| 5,738,173 | A | 4/1998 | Burge et al. | |
| 5,765,643 | A | 6/1998 | Shaaban et al. | |
| 5,839,514 | A * | 11/1998 | Gipson | 166/384 |
| 6,003,598 | A | 12/1999 | Andreychuk | |
| RE36,556 | E | 2/2000 | Smith et al. | |
| 6,158,516 | A | 12/2000 | Smith et al. | |
| 6,609,565 | B1 | 8/2003 | Andreychuk et al. | |
| 6,973,979 | B2 * | 12/2005 | Carriere et al. | 175/203 |
| 7,063,159 | B2 * | 6/2006 | Patton et al. | 166/355 |
| 7,185,708 | B2 * | 3/2007 | Wood et al. | 166/379 |
| 2003/0098150 | A1 | 5/2003 | Andreychuk | |
| 2004/0206551 | A1 | 10/2004 | Carriere et al. | |
| 2006/0283588 | A1 * | 12/2006 | Wood et al. | 166/77.2 |

* cited by examiner

*Primary Examiner*—Jennifer H Gay
*Assistant Examiner*—Robert E Fuller

(57) ABSTRACT

An apparatus for performing earth borehole operations comprising a base or substructure, a mast mounted on the base, a top drive mounted on the mast for longitudinal movement therealong, the top drive having an opening therethrough and a coiled tubing injector mounted on the mast above the top drive such that coiled tubing from the tubing injector can pass through the opening in the top drive, the apparatus being operable to selectively use the top drive to engage and manipulate a component used in borehole operations while the coiled tubing injector is substantially inoperative and selectively operable to use the coiled tubing injector to inject coiled tubing into an earth borehole while the top drive is substantially inoperative or alternatively using the coiled tubing injector to inject coiled tubing into a tubular string being manipulated by the top drive.

4 Claims, 11 Drawing Sheets

APPARATUS FOR PERFORMING EARTH BOREHOLE OPERATIONS

CROSS REFERENCE TO RELATED APPLICATIONS

The application is a continuation-in-part of U.S. patent application Ser. No. 11/107,183, filed Apr. 15, 2005 now abandoned for APPARATUS AND METHOD FOR PERFORMING EARTH BOREHOLE OPERATIONS, which is incorporated herein in its entirety for all purposes.

BACKGROUND OF THE INVENTION

1. Field of the Invention

The invention relates to apparatus for performing earth borehole operations such as drilling, and in particular to apparatus which can use both coiled tubing and jointed-pipe.

2. Description of Prior Art

The use of coiled tubing (CT) technology in oil and gas drilling and servicing has become more and more common in the last few years. In CT technology, a continuous pipe wound on a spool is straightened and pushed down a well using a CT injector. CT technology can be used for both drilling and servicing.

The advantages offered by the use of CT technology, including economy of time and cost are well known. As compared with jointed-pipe technology wherein typically 30-45 foot straight sections of pipe are threadedly connected one section at a time while drilling the wellbore, CT technology allows the continuous deployment of pipe while drilling the well, significantly reducing the frequency with which such drilling must be suspended to allow additional sections of pipe to be connected. This results in less connection time, and as a result, an efficiency of both cost and time.

However, the adoption of CT technology in drilling has been less widespread than originally anticipated as a result of certain problems inherent in using CT in a drilling application. For example, because CT tends to be less robust than jointed-pipe for surface-level drilling, it is often necessary to drill a surface hole using jointed-pipe, cement casing into the surface hole, and then switch over to CT drilling. Additionally, when difficult formations such as rock are encountered down-hole, it may be necessary to switch from CT drilling to jointed-pipe drilling until drilling through the formation is complete, and then switch back to CT drilling to continue drilling the well. Similarly, when it is necessary to perform drill stem testing or coring operations to assess conditions downhole, it may again be necessary to switch from CT drilling to jointed-pipe drilling and then back again. Finally, a switch back to jointed pipe operations may be necessary to run casing into the drilled well. In short, in CT drilling operations it is generally necessary for customers and crew to switch back and forth between CT drilling rig and jointed-pipe conventional drilling rigs, a process which results in significant down-time as one rig is moved out of the way, and another rig put in place.

Another disadvantage of CT drilling is the time consuming process of assembling a (bottom-hole-assembly (BHA)—the components at the end of the CT for drilling, testing, well servicing, etc.), and connecting the BHA to the end of the CT. Presently, this step is performed manually through the use of rotary tables and make-up/breakout equipment. In some instances, top drives are used but the CT injector and the top drive must be moved out of each others way, i.e., they cannot both be in line with the borehole. Not only does this process result in costly downtime, but it can also present safety hazards to the workers as they are required to manipulate heavy components manually.

In U.S. Publication 2004/0206551 there is disclosed a rig adapted to perform earth borehole operations using both CT and/or jointed-pipes, the CT injector and a top drive being mounted on the same mast, the CT injector being selectively moveable between a first position wherein the CT injector is in line with the mast of the rig and hence the earth borehole and a second position wherein the CT injector is out of line with the mast to allow operations using the top drive involving jointed pipe.

SUMMARY OF THE INVENTION

In one aspect, the present invention provides an apparatus for performing earth borehole operations comprising a base or substructure, a mast mounted on the base, a top drive mounted on the mast for longitudinal movement therealong, the top drive having an opening therethrough, and a coiled tubing injector mounted on the mast above the top drive such that coiled tubing from the tubing injector can pass through the opening in the top drive.

In another aspect, the present invention provides an apparatus for connecting the tubing of a coiled tubing injector to a bottom hole assembly comprising a base or substructure; a mast mounted on the base; a top drive mounted on the mast for longitudinal movement therealong, the top drive having an opening therethrough; a coiled tubing injector mounted on the mast above the top drive such that coiled tubing from the coiled tubing injector can pass through the opening in the top drive; a rotary table mounted on the base, the rotary table being operable to engage and manipulate a first component of a bottom hole assembly, the top drive being operable to engage and manipulate a second component of a bottom hole assembly, the top drive and the rotary table being cooperatively operable to make up a complete bottom hole assembly, the coiled tubing injector being selectively operable to move coiled tubing through the opening in the top drive and into and out of engagement with the complete bottom hole assembly.

In still another aspect of the present invention, there is provided a method of performing earth borehole operations comprising: providing a base; providing a mast mounted on the base; providing a top drive mounted on the mast for longitudinal movement therealong, the top drive being operable to engage and manipulate components used in earth borehole operations, the top drive having an opening therethrough; providing a coiled tubing injector mounted on the mast above the top drive such that coiled tubing from the injector can be passed through the opening in the top drive; providing a rotary table mounted on said base; selectively using the top drive to engage and manipulate a component(s) used in earth borehole operations while the coiled tubing injector is substantially inoperative; and selectively using the coiled tubing injector to inject coiled tubing into the earth borehole while the top drive is substantially inoperative, the coiled tubing passing through the opening in the top drive.

In another aspect, the present invention provides a method of performing earth borehole operations comprising: providing a base; providing a mast mounted ori the base; providing a top drive mounted on the mast for longitudinal movement therealong, the top driving being operable to engage and manipulate a component used in earth borehole operations, the top driving having an opening therethrough; providing a coiled tubing injector mounted on the mast above the top drive such that coiled tubing from the injector can pass through the opening in the top drive; using the top drive to engage and manipulate a component used in earth borehole operations; and using the coiled tubing injector to inject coiled tubing into said component through said opening in said top drive.

DESCRIPTION OF THE PREFERRED EMBODIMENTS

Figure 1:
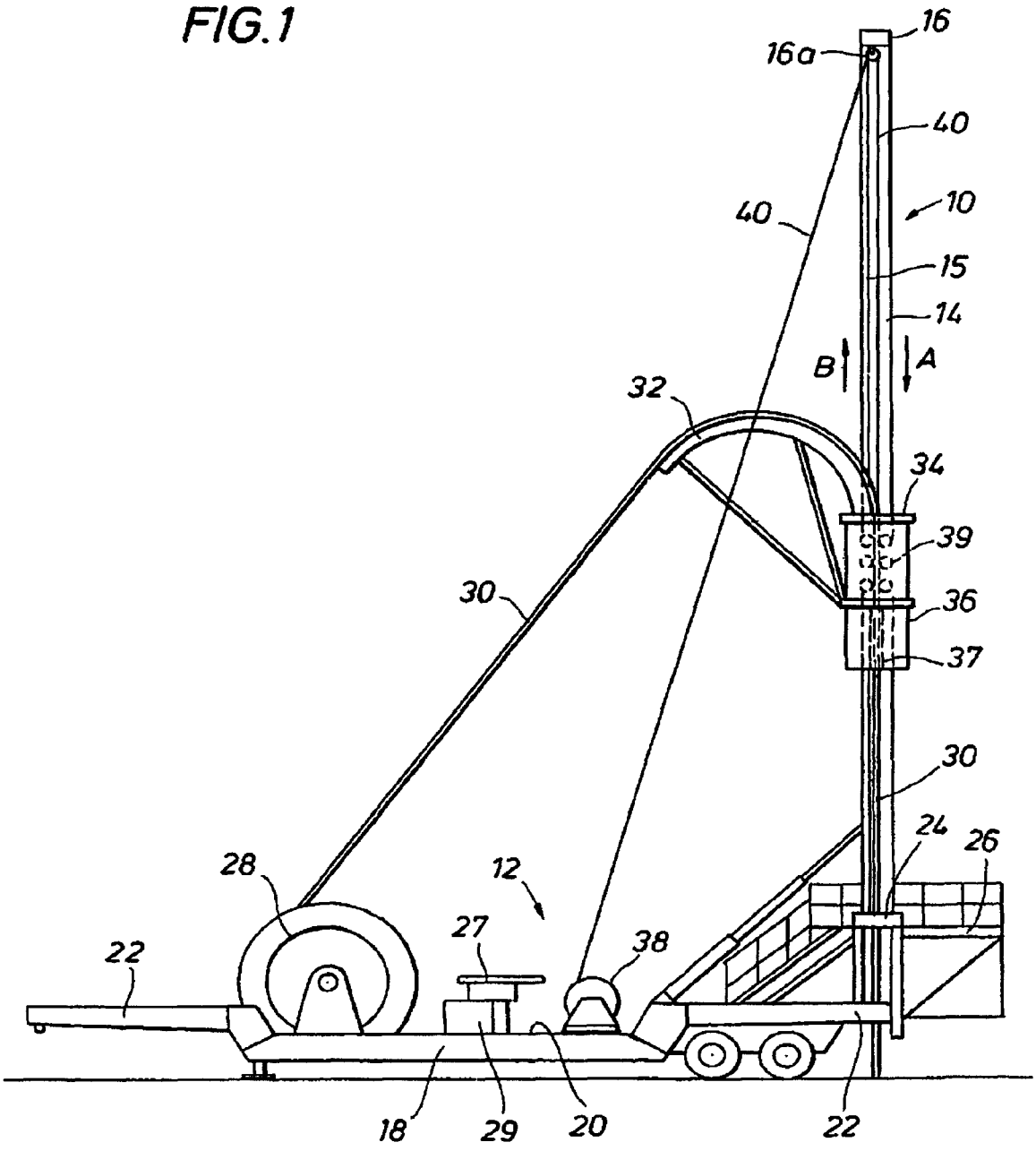
FIG. 1 is a partial, side elevational view of an apparatus according to the present invention.
Figures 3, 3A:
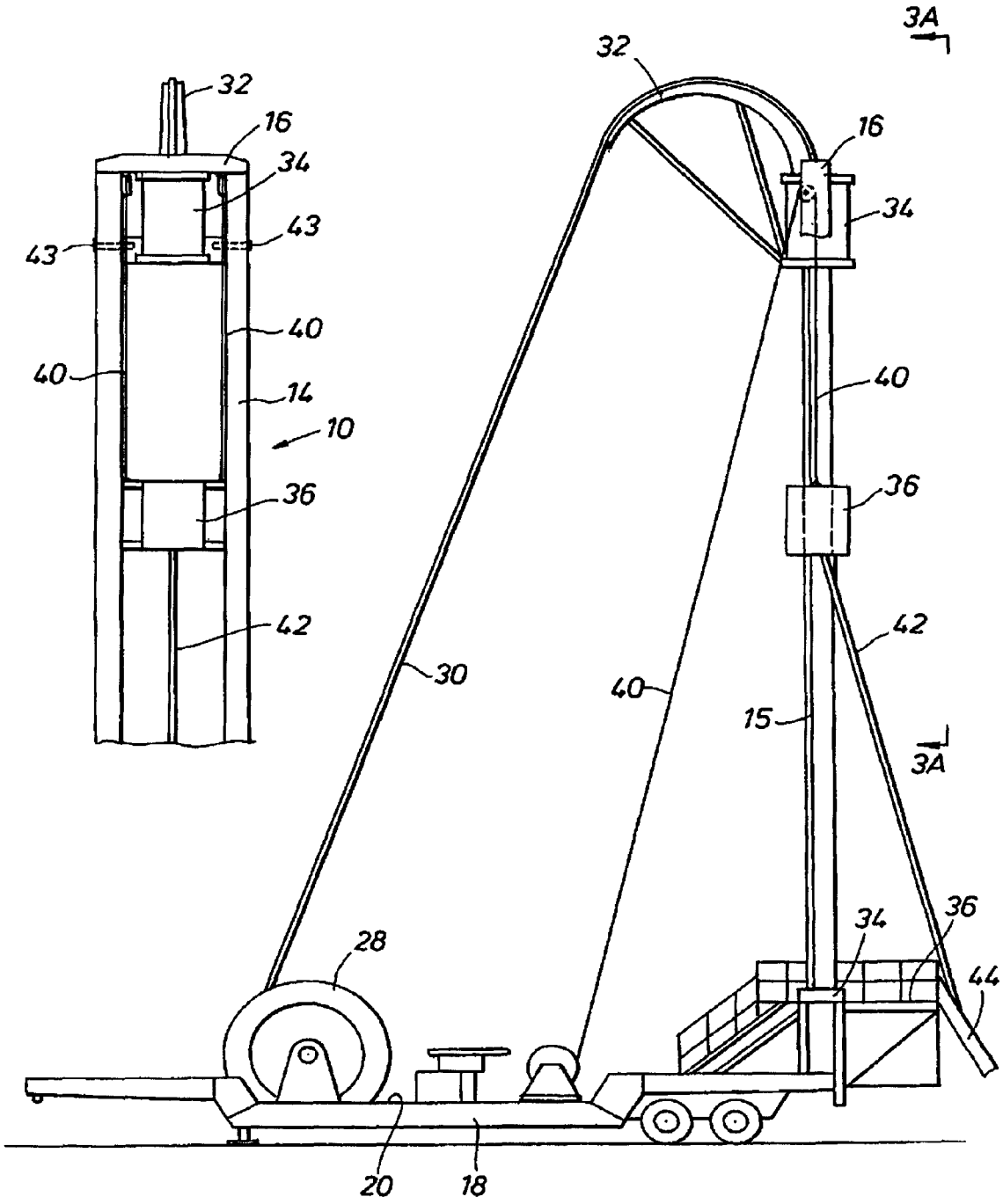
FIG. 3 is a partial, side elevational view of the apparatus shown in FIG. 1, wherein the top drive is manipulating a tubular component.
FIG. 3A is a view taken along the lines 3A-3A of FIG. 3.

Referring first to FIG. 1, the apparatus of the present invention is seen to comprise a mast, shown generally as 10, and a base shown generally as 12. Mast 10, as shown particularly with reference to FIG. 3A, is comprised of a pair of spaced elongate frame members 14 interconnected at the top by a crown 16. Although not shown, mast 10 is pivotally connected to base 12 for reasons described hereafter. However, it is not necessary that mast 10 be pivotally connected to base 12, i.e., it could be fixedly attached, if desired. As shown, base 12 comprises a wheeled carrier or trailer 18 providing a generally centrally located platform 20, the wheeled carrier 18 having a tongue 22 which can be attached to a motorized vehicle such that the trailer 18 can be moved from one location to another. It will be appreciated that the wheeled carrier 18 can be self propelled and even further that the base can comprise a stationary structure as, for example, a skid or the like which can be raised and placed on a trailer or other transport vehicle for movement to another site, if desired. It will also be appreciated that the apparatus of the present invention could be mounted on an offshore platform via a skid or other substructure on while the mast and other components are mounted. Wheeled trailer 18 also provides a second, rear platform 26 on which is mounted a rotary table 24. Rear platform 22 provides a work surface 26 for workers to manipulate various downhole components into and out of the rotary table and to perform other normal operations in conjunction with earth borehole operations such as drilling, workover, servicing, etc.

Rotatably mounted on the platform 18 is a spool 28 upon which is wound a length of coiled tubing 30. Spool 28 can be rotated in clockwise and counterclockwise directions using a suitable drive assembly (not shown). Also located on platform 18 is an engine 27 and a hydraulic tank 29 for storage of hydraulic fluid used in operating the various hydraulic components of the apparatus, e.g., motors, hydraulic cylinders, etc. As is well known, most of the components of the apparatus can be operated hydraulically, electrically or, in some cases, pneumatically. The coiled tubing 30 extends up to a gooseneck or guide 32 supported in a well-known manner. The gooseneck 32 is attached to a coiled tubing injector 34 which, as shown in FIG. 3A, is positioned between members 14 forming mast 10. As is well-known to those skilled in the art, coiled tubing injector 34 typically comprises a series of blocks, sprockets or like grippers driven by endless chains or belts, shown in phantom as 39, and which grab the coiled tubing 30 and force it downwardly in the direction of arrow A when it is being injected into a well and move it upwardly in the direction of arrow B when it is being removed from the well.

As shown in FIGS. 1 and 3A, a top drive 36 is mounted on mast 10 between members 14 for longitudinal movement therealong in either the direction of arrow A or arrow B. Typically, top drive 36 is mounted on a track system, indicated as 15, which is affixed to members 14. It will be recognized, however, that top drive 36 could be suspended in other fashions other than the track system 15 such that it could be longitudinally moved along mast 10. Top drive 36 is moved longitudinally along mast 10 by a hoisting system comprised of a winch or draw works mounted on platform 18 and one or more cables 40 which run through a crown block sheave assembly 16*a* located at the top of mast 10. The cables 40 pass through or by coiled tubing injector 34 and are attached to top drive 36 in a well-known manner whereby draw works 38 can selectively raise top drive 36 upwardly along mast 10 or lower top drive 36 downwardly along mast 10, i.e., in the directions of arrows A and B, respectively. In the embodiment shown in FIG. 1, the top drive serves as an elevator for the coiled tubing injector 34, in that movement of the coiled tubing injector 34 longitudinally along the mast 10 is effected by movement of the top drive 36. In this regard, as noted, the cables 40 run through or alongside coiled tubing injector 34 and are attached to the top drive 36 in the well-known manner. It will be understood however that, while more complicated, coiled tubing injector 34 could be moved independently along mast 10 by a separate draw works or winch. However, the apparatus of the present invention is vastly simplified by using the top drive 36 as an elevator to effect longitudinal movement of coiled tubing injector 34.

As seen in FIG. 1, top drive 36 has an opening 37 extending longitudinally therethrough for a purpose to be described hereafter. While the opening 37 has been described as extending longitudinally through the top drive 36, it is conceivable that a top drive unit could be designed such that the opening was not through the top drive but rather was an opening in the form of a slot on the side of the top drive. Obviously, such a top drive would be more complicated in construction and might have to accommodate lateral movement such that when the top drive was being used it was aligned with the vertical axis of the borehole, but when the tubing injector was being used, the tubing issuing therefrom would also be aligned with the vertical axis of the borehole. Accordingly, the phrases "longitudinally therethrough", "therethrough", or "through" with respect to the opening in the top drive is intended to include slots or other formations in the top drive which permit the coiled tubing injector to be positioned above the top drive and the coiled tubing maintained in line with the vertical axis of the wellbore. A suitable top drive for use in the apparatus of the present invention is a Foremost Model F-100T. The Foremost Model F-100T is a hydraulic top drive system and is commercially available. As in the case with other top drive systems, the Model F-100T is provided with hydraulically actuated bails to assist in picking up or laying down tubulars and includes a hydraulically actuated tong assembly mounted on the top drive to assist in breakout/make-up of the drill string or other tubular downhole strings.

It will be appreciated that when, as in the embodiment shown in FIG. 1, top drive 36 is serving as an elevator for coiled tubing injector 34, provision could be made to have a platform, cradle or the like upon which coiled tubing injector 34 would rest, the platform in turn resting on top drive 36. In any event, it will be appreciated that there are a variety of ways in which the coiled tubing injector 34 can be positioned above top drive 36, such that top drive 36 can serve as an elevator for top drive 34. For example, while as shown in FIG. 1 coiled tubing injector 34 and top drive 36 are basically adjacent one another, it is contemplated that some axial spacing could be accommodated, if necessary, consistent with having enough longitudinal length along mast 10 for top drive 36 to act independently when necessary. Such a situation would occur, for example, when top drive 36 was being used to drill a surface borehole, run casing, etc. In any event, it will be appreciated that with coiled tubing injector 34 positioned above top drive 36, and with top drive 36 having an opening 37 extending longitudinally therethrough, coiled tubing 30 from coiled tubing injector 34 can be passed through top drive 36 in which event top drive 36 would be basically inoperative save for its function as serving as an elevator for coiled tubing injector 34.

Figure 2:
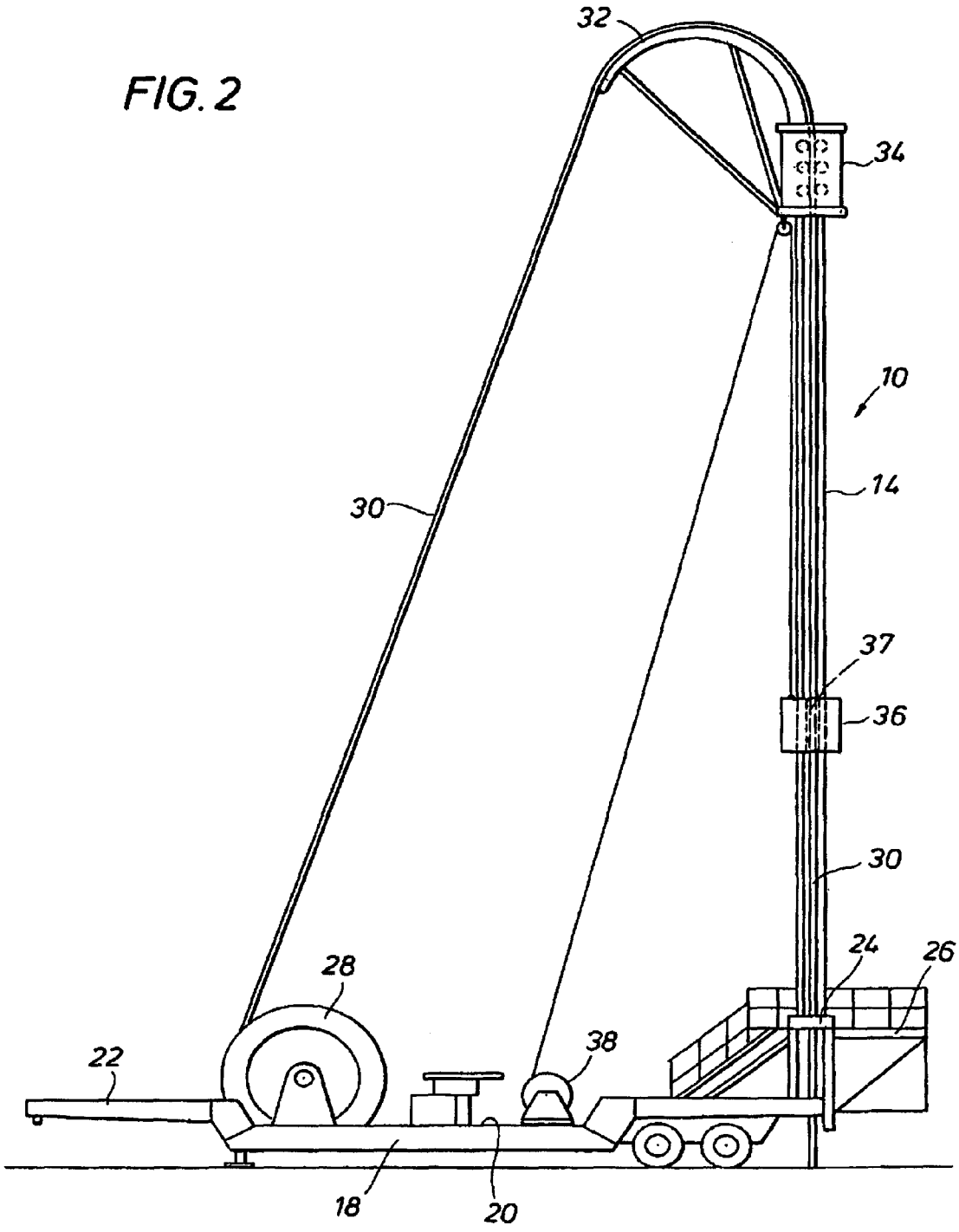
FIG. 2 is a partial, side elevational view of a second embodiment of the apparatus of the present invention.

Turning now to FIG. 2, there is shown another embodiment of the present invention, wherein the coiled tubing injector 34 is mounted on the crown of the mast 10 such that it is not longitudinally movable along the mast 10, but is still above top drive 36 such that, as in the case of the embodiment shown in FIG. 1, coiled tubing 30 from injector 34 passes through the opening 37 in top drive 36.

The present invention provides a universal rig which can selectively handle and run different types of pipe, coiled tubing, and other earth borehole equipment thereby eliminating the need for two rigs—one rig to use a top drive in the conventional manner and a separate coiled tubing injector unit to perform coiled tubing operations. Thus, in the embodiments shown in FIGS. 1 and 2, the coiled tubing injector 34 is being used to manipulate coiled tubing 30, the coiled tubing 30 passing through the top drive 36, the top drive 36 being basically in an inoperative position vis-a-vis manipulating tubular components, components of bottom hole assemblies or the like. However, and as noted above, in the embodiment of FIG. 1, top drive 36 does serve the purpose of being an elevator for coiled tubing injector 34.

Turning now to FIG. 3, there is shown an embodiment of the present invention wherein the coiled tubing injector 34 is basically in an inoperative position while the top drive 36 is being operated to manipulate tubular components. In the embodiment shown in FIG. 3, the coiled tubing injector 34 is moved to the crown 16 of the mast 10 and is held in that position by a latching or locking mechanism as, for example, one or more pins 43 (see FIG. 3A) which are operatively mounted in mast 10 and which can be selectively operated, electrically, hydraulically or in any other suitable fashion, to engage coiled tubing injector 34 or a cradle therefor and hold it in that position. It will also be understood that a plurality of such latching or locking mechanisms can be spaced longitudinally along mast 10 such that coiled tubing injector 34 can be held at a variety of desired, longitudinally spaced locations along mast 10. It will also be appreciated that provision could be made to use a screw mechanism extending longitudinally along members 14 which could selectively engage or disengage injector 34 to continuously or incrementally move coiled tubing injector 34 along mast 10 rather than having longitudinally spaced latching mechanisms such as the use of pins 43. In any event, with coiled tubing injector 34 temporarily locked in the position shown in FIG. 3, i.e., at crown 16, the top drive 36 can now perform operations typically performed by a top drive such as, for example, manipulating a tubular component such as casing 42 brought in through the V-door 44 as is common in typical oilfield operations. Although not shown, it will be appreciated that the apparatus of the present invention would be provided with elevators and other components normally used to manipulate downhole components, e.g., pipe, as for example, to grip the pipe or other downhole component and move it to a position where it could be engaged and subsequently manipulated by the top drive. Thus, using the apparatus of the present invention in the manner depicted in FIG. 3, the tubing injector 34 would be inoperative while top drive 36 would be operative. This ability to selectively use the top drive and the injector independently of one another is clearly advantageous in terms of saving cost and time.

Figure 4:
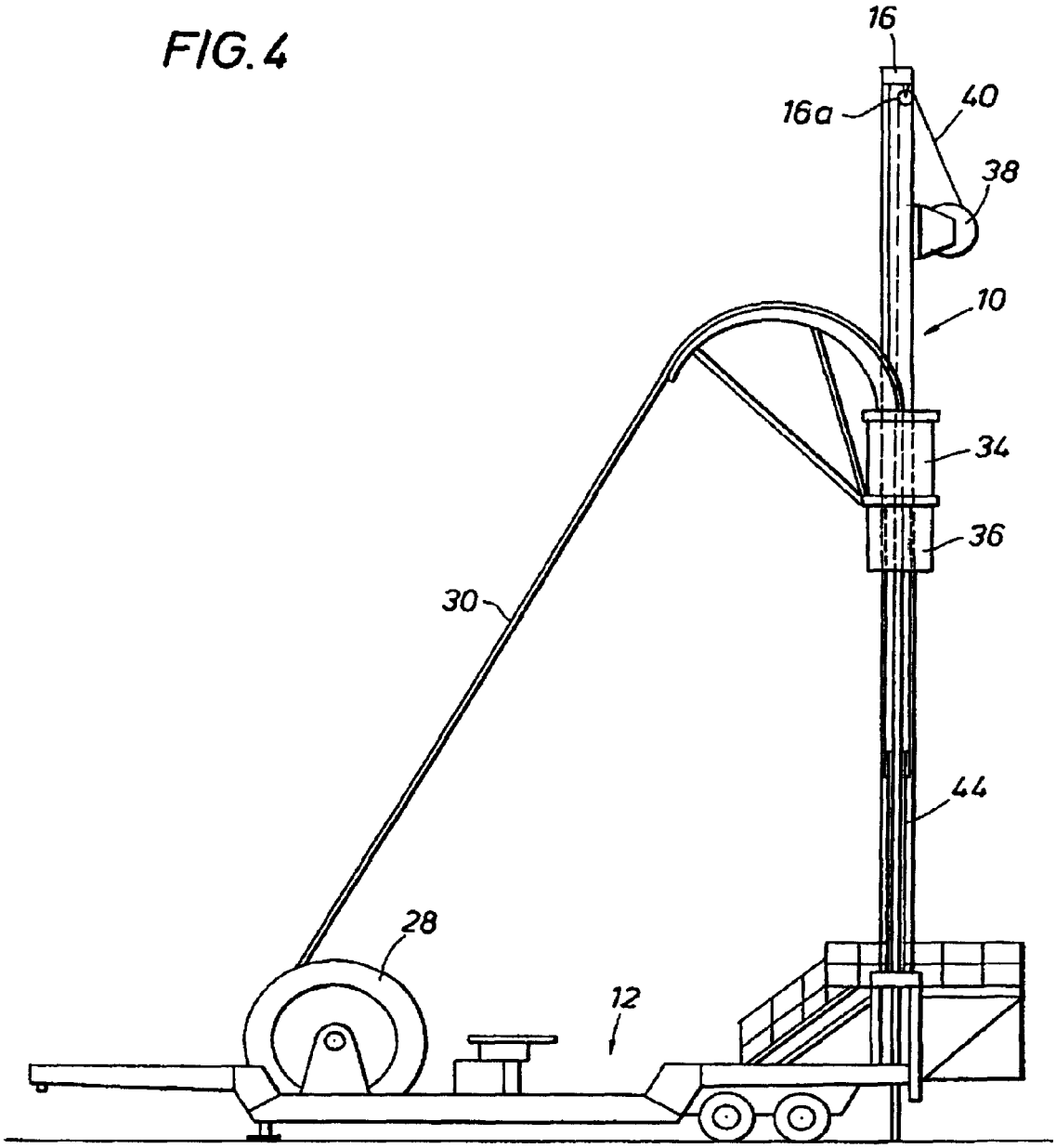
FIG. 4 is a partial, side elevational view of another embodiment of the apparatus of the present invention.

With reference now to FIG. 4, there is shown a slightly different embodiment wherein the draw works 38 is mounted on the mast 10, the cables 40 running through the crown block **16*a* in the crown 16 and down to the top drive 36. It will be appreciated that in cases, such as the embodiment shown in FIG. 4, wherein the draw works 38 is mounted on the mast, the draw works could be removably mounted, carried on a trolley, hingedly attached or the like, such that, for transportation purposes, the draw works could basically be moved to a position that it did not extend above the mast when the mast was lowered to the horizontal, transportation position. As shown in FIG. 4, extending from coiled tubing injector 34, is a telescoping lubricator 44, lubricator 44 facilitating connection or disconnection of coiled tubing 30 with a bottom hole assembly. As is well known to those skilled in the art, lubricator 44** can be extended or contracted using a lubricator winch (not shown).

Figure 5:
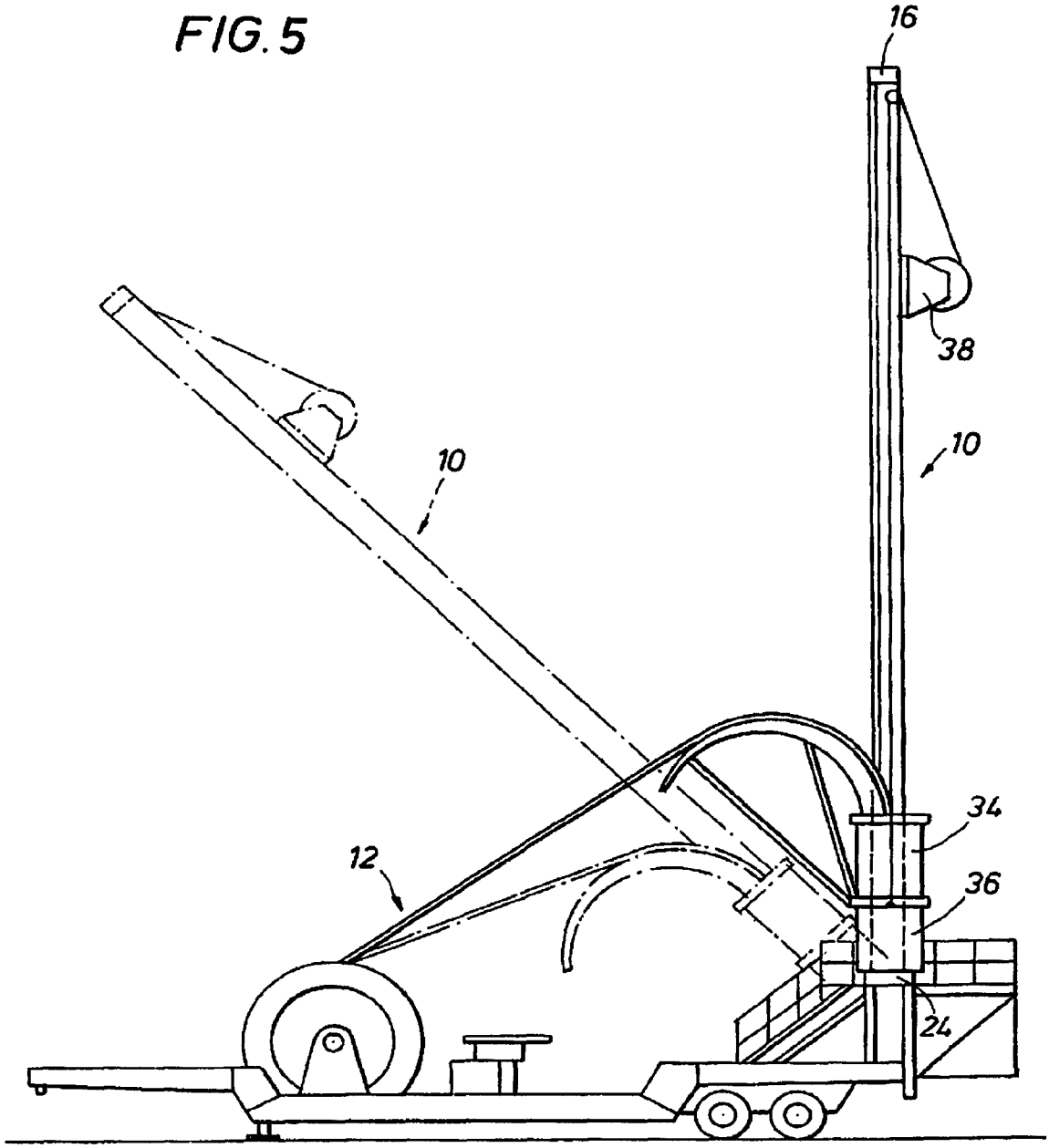
FIG. 5 is a partial, side elevational view of the apparatus of the present invention shown in FIG. 4 with the coiled tubing injector in a position to perform earth borehole operations and shows, in phantom, positioning the mast of the apparatus at an angle to the horizontal to effect off-vertical earth borehole operations.

Referring now to FIG. 5, there is shown still another, modified embodiment of the apparatus shown in FIG. 1 wherein the draw works 38, as in the case of the embodiment shown in FIG. 4, is mounted on the mast 10. In the embodiment shown in FIG. 5, the top drive 36 and the injector 34 have been moved to the lowermost position, i.e., adjacent rotary table 24, and in this position, top drive 36 would be essentially inoperative and coiled tubing injector 34 would be operative to perform downhole operations such as drilling, workovers, etc. Additionally, and as can be seen, mast 10 can be pivoted relative to the base 12 by a pivoting assembly (not shown) to a position depicted in phantom in FIG. 5. Thus, it can be seen that the mast 10 can be lowered off vertical to operate at any operating angle between the horizontal and vertical to permit off-vertical drilling. It would also be understood that in cases where off-angle well operations were being performed, reorientation of the rotary table and other component would have to be accommodated. Additionally using a pivoting connection between the mast 10 and the base 12 allows the mast 10 to be lowered to a substantially horizontal position for purposes of moving the apparatus to another location if base 12 comprises a wheeled carrier which is either self-propelled or can be pulled by a motorized vehicle, a skid or the like, etc.

As noted above, the apparatus of the present invention is universal in the sense that the same rig carries a coiled tubing injector to manipulate coiled tubing and a top drive to manipulate jointed pipe or other downhole components, the injector and the top drive being selectively, independently operable to perform their customary functions. Additionally, the universal nature of the apparatus of the present invention is attested to by the fact that when the top drive is being used to manipulate a downhole component, e.g., a string of pipe, such as casing, tubing, drill pipe, etc., the coiled tubing injector can be simultaneously used to inject coiled tubing through the top drive into the string of pipe to perform an operation as, for example, freeing the pipe string if it is stuck or to some other downhole operation.

Figure 6:
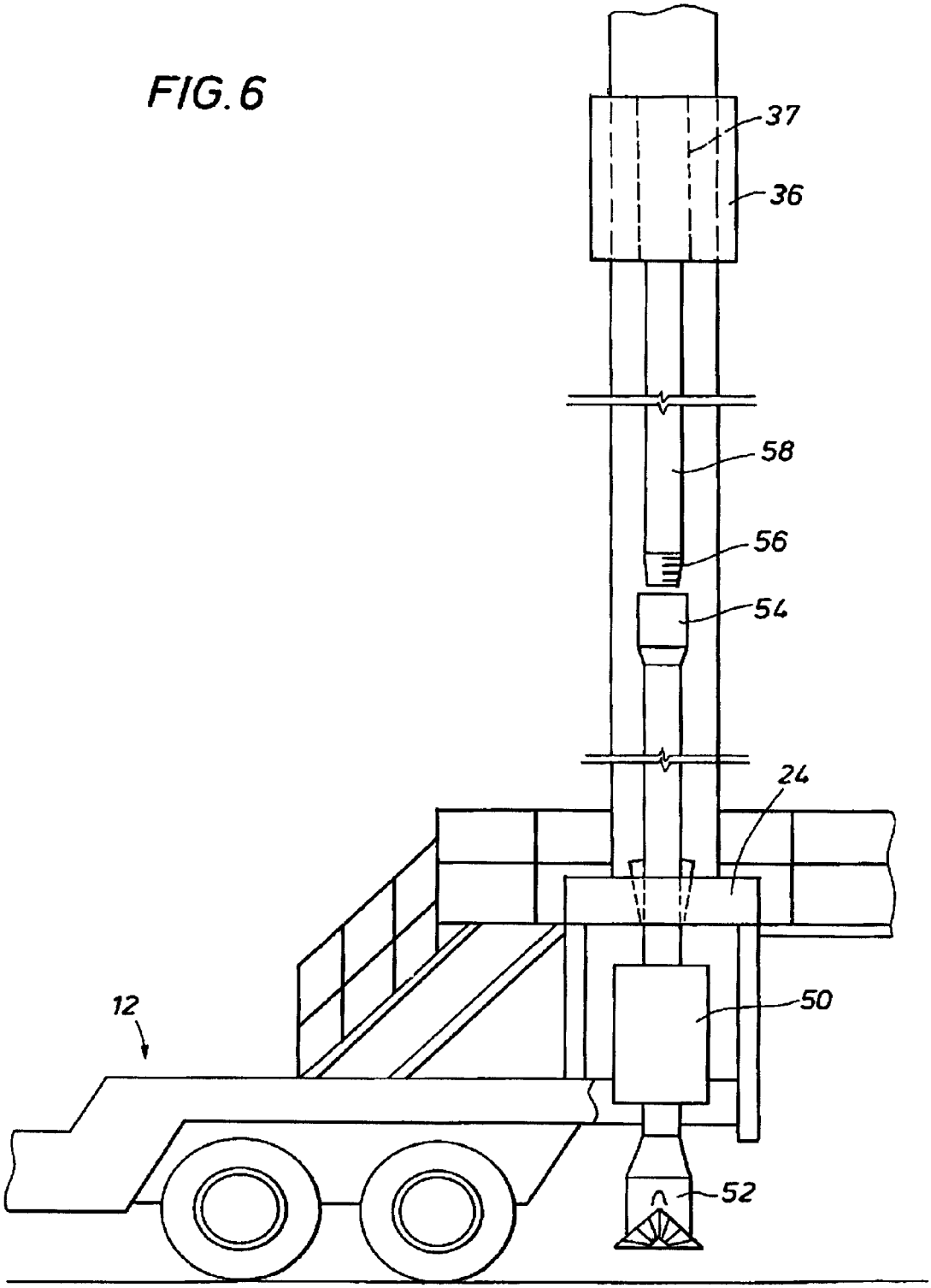
FIG. 6 is a side, partial elevational view showing a bottom hole assembly being made up using the apparatus of the present invention.

The present invention also provides an efficient apparatus to cooperatively use the coiled tubing injector and the top drive. In this regard and referring to FIG. 6, the top drive 36 is shown in a position displaced axially up from the rotary table 24, the injector being positioned at the crown as shown in FIG. 3. In the embodiment shown in FIG. 6, the rotary table 24 is suspending a downhole motor 50 on the end of which is connected to a drill bit 52. As can be seen, the threaded box end 54 of the downhole motor 50 (or a component attached to the downhole motor 50), is in a position to receive the threaded pin 56 of a second downhole component 58 which can be a part of a bottom hole assembly or alternatively, a conventional tubular member. To connect pin 56 with box 54, top drive 36 is lowered until pin 56 is received in box 54. At this point, with the rotary table 24 holding the downhole motor 50 fixed against either rotation or longitudinal movement, top drive 36 can be rotated to thread pin 56 into box 54. Alternatively, it will be understood that top drive 36 could be used to hold component 58 against rotation while it was slowly being lowered and the rotary table 24 could be used to rotate the downhole motor 50 which again would cause threaded engagement between pin 56 and box 54. As noted, in the embodiment shown in FIG. 6, component 58 could be part of a string of pipe wherein a plurality of joints of pipe are successively connected together, the portion of the pipe string suspended in the rotary table 24 being released and lowered as each successive joint of pipe is connected whereby eventually the entire string is lowered into the borehole. FIG. 6 also depicts a method of making up and connecting a complete bottom hole assembly to the end of the coiled tubing from the coiled tubing injector 34. Thus with the assembly shown in FIG. 6, once a complete bottom hole assembly, e.g., drill bit, downhole motor, drill collars, logging equipment, sensors, etc., is made up, the end of the coiled tubing and the uppermost member of the complete bottom hole assembly could be operatively engaged using intergaging latching mechanisms whereby the coiled tubing could be latched into the uppermost member of the complete bottom hole assembly and, when the bottom hole assembly is retrieved unlatched, if desired.

Figures 7, 7A:
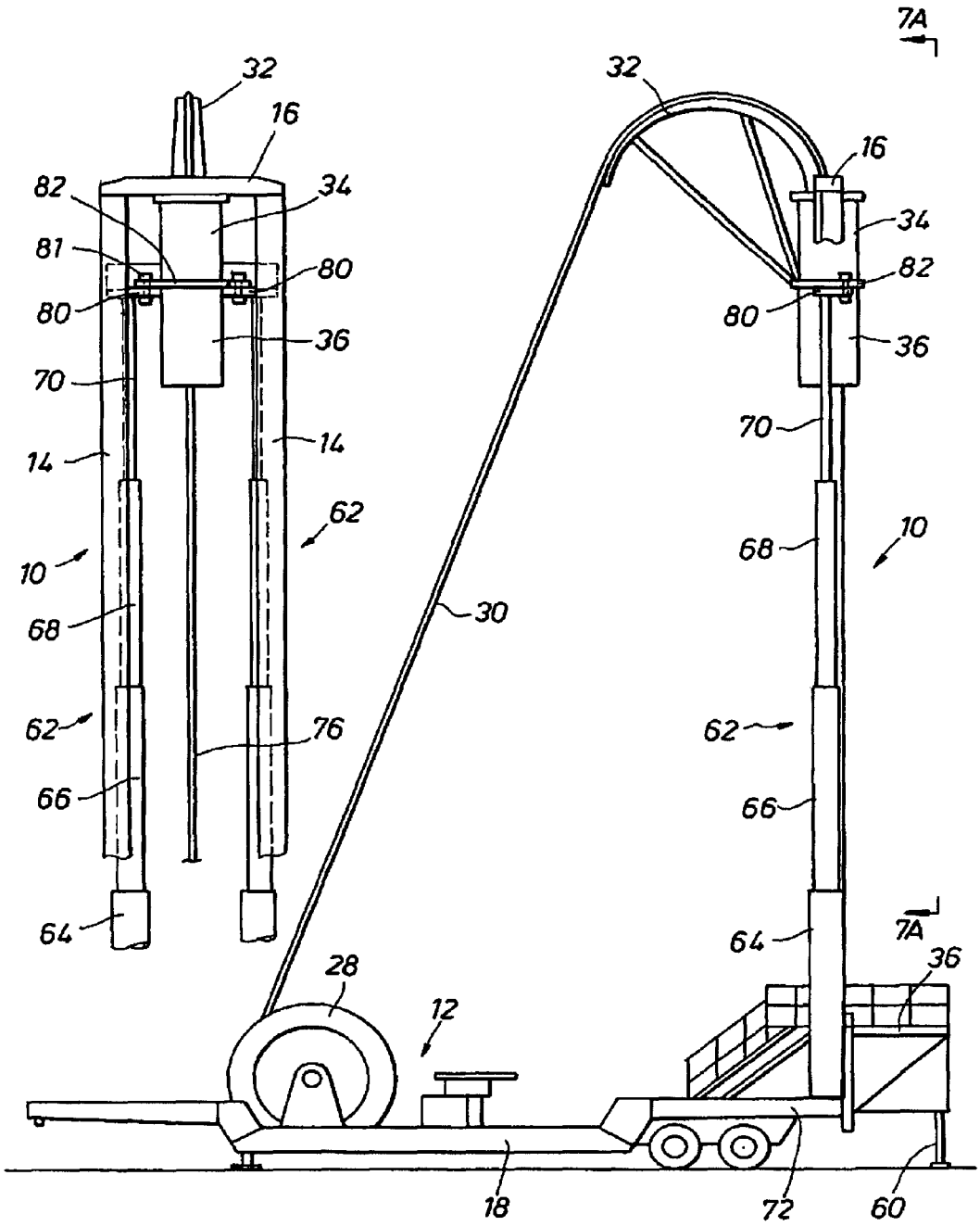
FIG. 7 is a side, partial elevational view showing another embodiment of the apparatus of the present invention wherein the hydraulic ram system is used as the lifting mechanism for the top drive.
FIG. 7A is a view taken along the lines 7A-7A of FIG. 7.

Referring now to FIGS. 7 and 7A, there is shown an embodiment of the present invention wherein, as an alternative, telescoping hydraulic cylinder systems are used to move the top drive longitudinally along the mast. The apparatus shown in FIGS. 7 and 7A might be utilized when the mast 10 was unusually long, e.g., on an offshore platform and in a situation where the top drive 36 was manipulating longer strings of jointed pipe that would result in greater loading that might make a draw works lifting system such as shown in the embodiments described above, impractical or at least require a larger winch, more and heavier cables, etc. As can be seen from FIG. 7, the system depicted in FIGS. 7 and 7A has no draw works. Additionally, the base 12 has support legs 60 located generally under platform 36 to support the extra weight occasioned by the hydraulic cylinder system employed and any additional loading from the mast, pipe being handled, etc. It would be appreciated that the leg 60 could be selectively extended and retracted as desired. The hydraulic cylinder systems shown generally as 62 can be made in a four-stage cylinder design comprised of cylinders 64, 66, 68 and 70, as which can be seen, are telescopically received into one another such that when all the hydraulic cylinders are in their lower most position, they are all received in lower cylinder 64. It is well known to those skilled in the art, that the cylinder systems would be operated using suitable pumps, hoses, accumulators (are not shown) well known to those skilled in the art. The hydraulic cylinder systems 62 are mounted on a platform 72 formed on base 12. It will be understood that with the use of the hydraulic cylinders and the increased weight, and if the base 12 was part of a wheeled carrier, as described above, the various portions of the base 12, particularly platform 72 would be built to accommodate the additional weight and the downward force exerted on the base 12 when the cylinder systems were in a lifting position such as shown in FIG. 7. As a practical matter, the apparatus shown in FIGS. 7 and 7A is more ideally suited to use on a base or sub-structure such as on an offshore platform that can easily accommodate heavy loads or downward forces. However, for purposes only of depicting the use of a hydraulic cylinder system(s) as a lifting or hoisting device for the top drive 36, the hydraulic cylinder system 62 has been shown as mounted on a wheeled carrier.

As can be seen particularly with reference to FIG. 7A, there could be two of such hydraulic cylinder systems 62, one each positioned adjacent, generally on the inside, of members 14 forming mast 10. Referring then to FIG. 7, the uppermost cylinders 70 are connected to plates 80 that in turn are generally releasably connected to top drive 36. As shown, plates 80 on top drive 36 are connected, via a nut and bolt arrangement or some other selectively releasable mechanism, to a flange 82 connected to coiled tubing unit 34. In this configuration, movement of the hydraulic cylinder systems 62 would effect movement of both the coiled tubing unit 34 and the top drive 36. However, if the nut and bolt combinations 81 were removed, top drive 36 could now be moved independently of coiled tubing injector 34 by the hydraulic cylinder systems 62 and, for example, coil tubing unit 34 could be latched or locked to the uppermost portion of the mast 10 below the crown 16 as, for example, by latching pins 43 such as shown in FIG. 3*a*.

Figure 8:
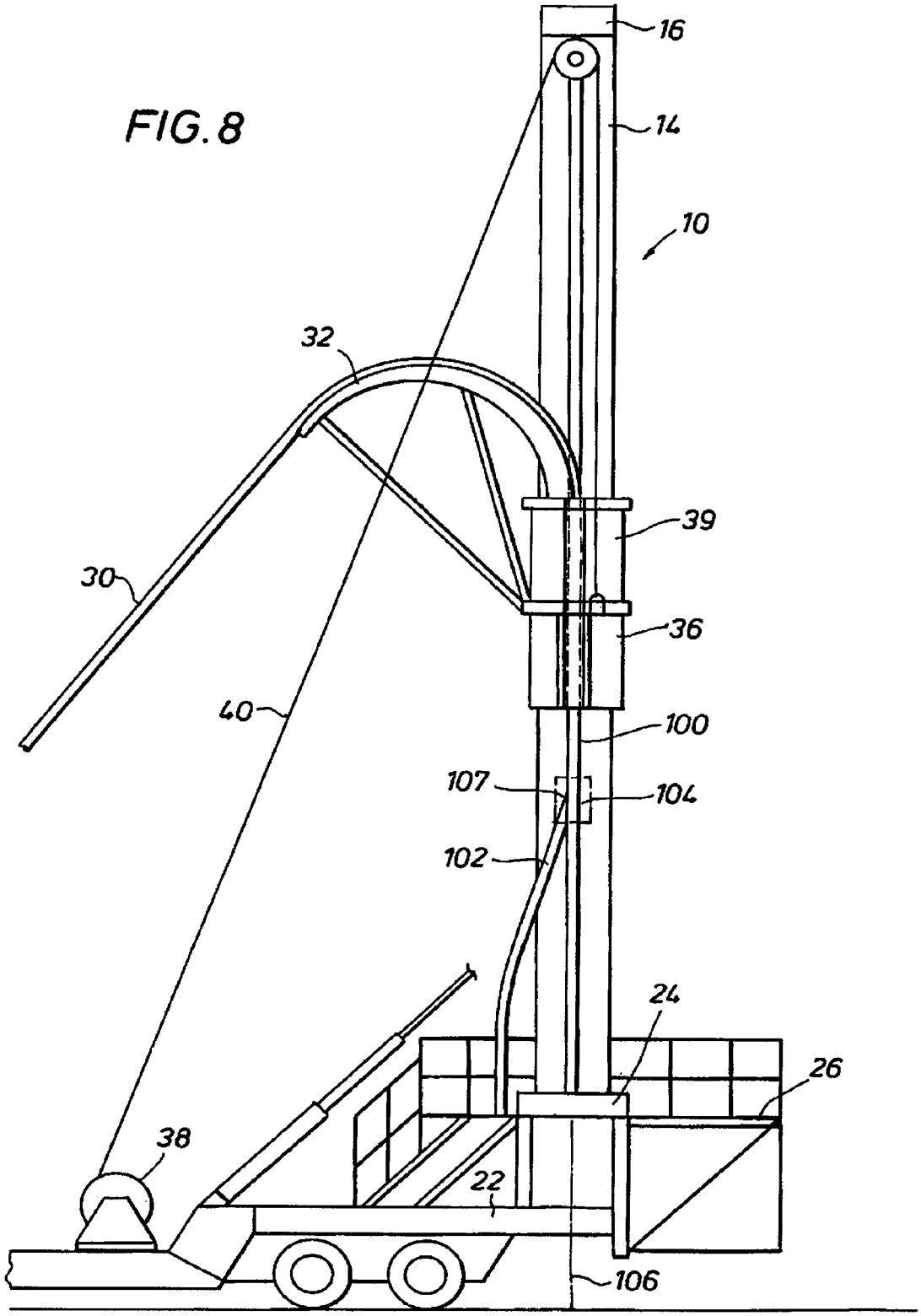
FIG. 8 is a partial, side elevational view of another embodiment of the apparatus of the present invention showing the top drive positioned directly below the coiled tubing injector on a track system secured to the mast.
Figure 9:
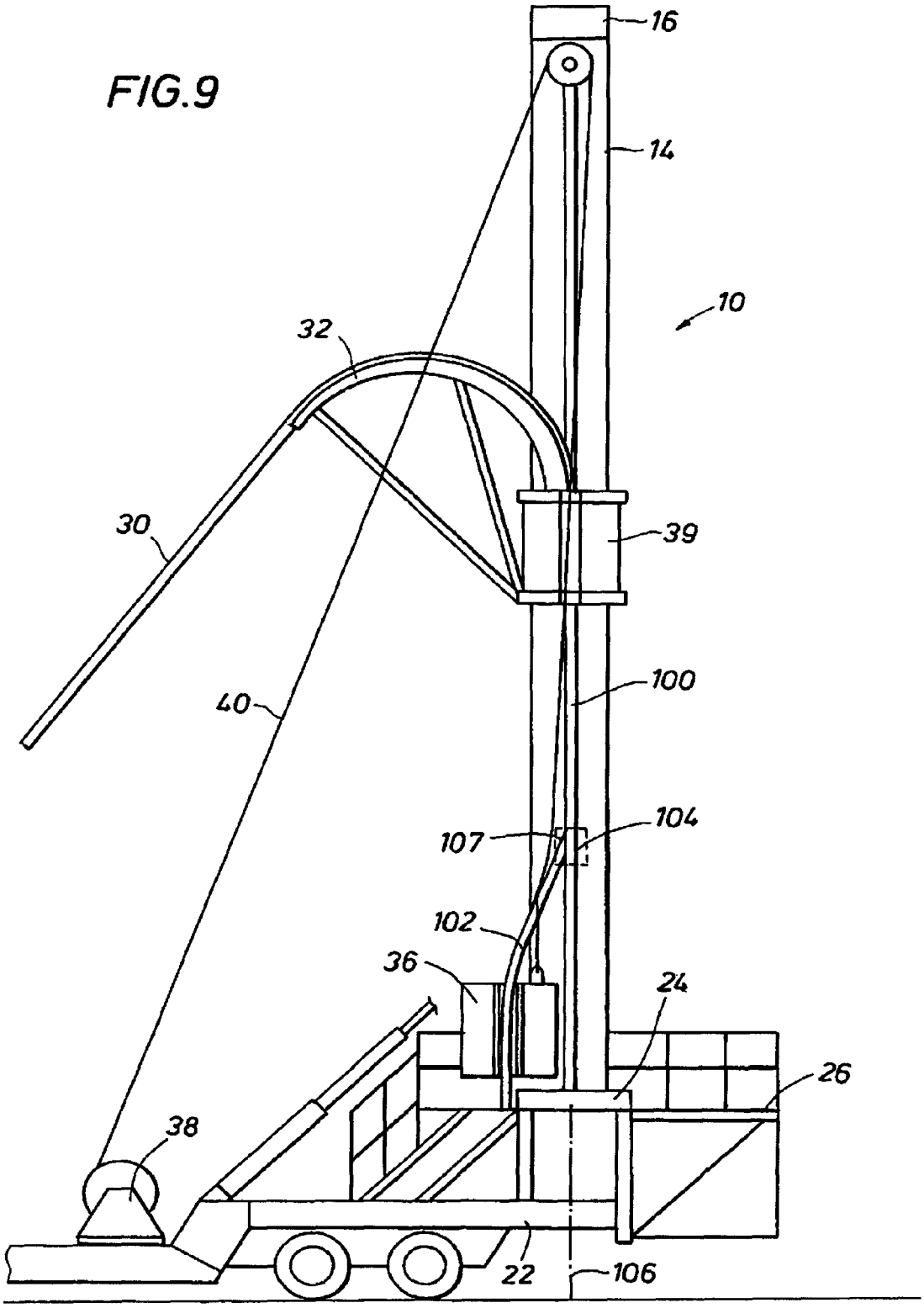
FIG. 9 is a partial, side elevational view of the embodiment shown in FIG. 8 but with the top drive moved laterally on a spur track system such that the top drive is laterally displaced from the coiled tubing injector.

As noted above, the system of the present invention positions the coiled tubing injector in the mast above the top drive such that coiled tubing issuing from the coiled tubing injector passes through the top drive. As further noted above, the coiled tubing need not move directly through any opening in the top drive but can move in slots or other openings along the side of the top drive. It is also contemplated that the top drive, albeit normally positioned below the coiled tubing injector, could be moved to one side or another in a lateral or transverse direction relative to the mast such that the coiled tubing injector remained in line with the wellbore while the top drive was out of alignment with the wellbore. Thus, the coiled tubing injector and the top drive could be temporarily in a side-by-side arrangement. This arrangement is particularly useful in relatively small rigs using relatively large diameter coiled tubing, e.g., 3". It will be understood, as described above, that normally a lubricator (see FIG. 4) will be employed when coiled tubing injector is connected to a bottom hole assembly. Referring then to FIGS. 8 and 9, there is shown one embodiment of the present invention wherein the coiled tubing injector can be releasably, fixedly positioned at a desired point along the mast and the top drive parked or moved laterally relative to the coiled tubing injector such that coiled tubing issuing from the coiled tubing injector passes alongside the top drive into the earth borehole. Each of frame members 14 of mast 10 is provided with a mast track 100 upon which coiled tubing injector 39 and top drive 36 travel longitudinally therealong. Each of mast tracks 100 has operatively connected thereto a spur track or rail 102 which extends transversely from mast tracks 100 to platform 26 or at least some distance laterally displaced from mast tracks 100. As shown in FIG. 8, top drive 36 is in the position acting as an elevator for coiled tubing injector 39 carried on top drive 36, the combination of the coiled tubing injector 39 and top drive 36 being positioned generally half way along the frame members 14 forming mast 10. As was described above, top drive 36 is free to move longitudinally along mast tracks 100 substantially from rotary table 24 to a desired upper position when coiled tubing injector 39 is positioned and releasably fixed in mast 10 proximate crown 16.

Referring now to FIG. 9, coiled tubing injector 39 is shown as being releasably, fixedly held in mast 10 in a manner described above, while top drive 36 is now positioned in the lower portion of mast 10 but laterally displaced from mast 10, coiled tubing injector 39 and the axis 106 of the wellbore. To accomplish this, coiled tubing injector 39 is releasably fixed in mast 10 at the location shown in FIG. 9. Top drive 36, as described, can move downwardly to a point 107 where spur tracks 102 operatively intersect mast tracks 100. At this point, a switching mechanism 104 is activated to divert a trolley or the like on which top drive 36 is sitting onto spur tracks 102 such that top drive 36 now moves downwardly but tranversely to mast tracks 100 and can then be parked or located at a position where it is out of alignment with the wellbore axis 106. As shown, top drive 36 has been moved relatively close to work surface 26 but it is apparent that it could be positioned higher from the position shown in FIG. 9, indeed even at least partially in the framework of mast 10, and still remain out of alignment with the axis 106 of the wellbore. In any event, once the top drive 36 is moved laterally relative to coiled tubing injector 39, coiled tubing injector 39 can then inject coiled tubing 30 through rotary table 34 and into the wellbore, the coiled tubing passing alongside top drive 36. It will also be appreciated that in the event coiled tubing injector 39 is provided with a separate hoisting mechanism as previously described, it could be moved along mast 10 independently of any movement of top drive 36. In any event, top drive 36 still serves as an elevator for coiled tubing injector 39 which can be positioned at a desired location in the mast 10 first, following which the top drive, if desired, can be moved into a laterally displaced position as shown in FIG. 9. The terms "operatively connected," "operatively intersect" or similar term with respect to the spur tracks 102 and mast tracks 100 is intended to mean that the two track systems are interrelated to the extent that the top drive 36 can be switched from mast tracks 100 to spur tracks 102 or vice versa.

Switching mechanism 104 can be any one of well known switching mechanisms used in track conveying systems to selectively switch a trolley or similar conveying device moving along a first track system to a second track system. Such switching systems can be mechanical, electromechanical, pneumatic, etc. It will also be appreciated that such switching mechanisms can be activated manually or automatically such that when, in this case, top drive 36 reaches a certain position, i.e., at the juncture or intersection of spur tracks 102 and mast tracks 100, the switching system has been set in an automatic mode to move the top drive from mast tracks 100 to spur tracks 102.

It is well known in the art that top drives used in oil and gas drilling and well servicing operations are commonly carried by a so-called integrated split block arrangement. In a split block arrangement, a frame having laterally spaced side members is provided with one or more sheaves on each of the spaced side members, each of the sheaves being connected by cables to a suitable crown block. The use of these split block arrangements reduces stack-up as is common in simple traveling block assemblies. Such a split block arrangement is ideally suited for use in the present invention to carry the top drive, the coiled tubing injector being positioned on a platform, cradle or the like which would rest on the top drive. In this manner, the split block assembly essentially forming part of the top drive, as described above, would act as an elevator for the coiled tubing injector. Typical of split block arrangements used in conjunction with top drives is the T75/T100 series of top drives manufactured and sold by TESCO Corporation as can be seen at www.tescocorp.com.

Referring now to FIGS. 10-13, there is shown a split block assembly for use in carrying the top drive used in the present invention. Frame members 14 of mast 10 are provided with longitudinally extending tracks 108 and 110. A generally rectangular frame F shown as 110 comprises a first side frame member 112, a second, laterally spaced side frame member 114, a first cross frame member 16 and a second, laterally spaced cross frame member 118, members 112, 114, 116 and 118 forming a generally rectangular opening in frame F. Pivotally attached to frame members 118 and 116 is a bail 120. Bail 120 is also pivotally attached to top drive 36 as shown at 122. A piston-cylinder assembly 124 has one end of the cylinder pivotally attached as at 125 to frame member 118, the pivot point 125 being laterally displaced toward side member 112 relative to the pivot point 121. Reciprocally extending out of the cylinder of piston-cylinder assembly 124 is a piston rod 126 which has one end pivotally attached at 122 to bail 120.

Side member 112 has attached thereto sheaves 130 and 132 while side member 110 has attached thereto sheaves 134 and 136. Cables 138, 140, 142 and 146 extend from sheaves 130, 132, 134 and 136, respectively, up to a crown block assembly (not shown) as is well known to those skilled in the art. Thus, by movement of the cables 138-146, frame F can be moved longitudinally along tracks 108 and 110 and hence longitudinally along the mast 10 formed by frame members 14. To this end, roller assemblies 160 and 162 are attached to side frame member 112, while roller assemblies 164 and 166 are attached to side frame 110. As shown, roller assemblies 160 and 162 engage track 108 while roller assemblies 164 and 166 engage track 109.

Figure 11:
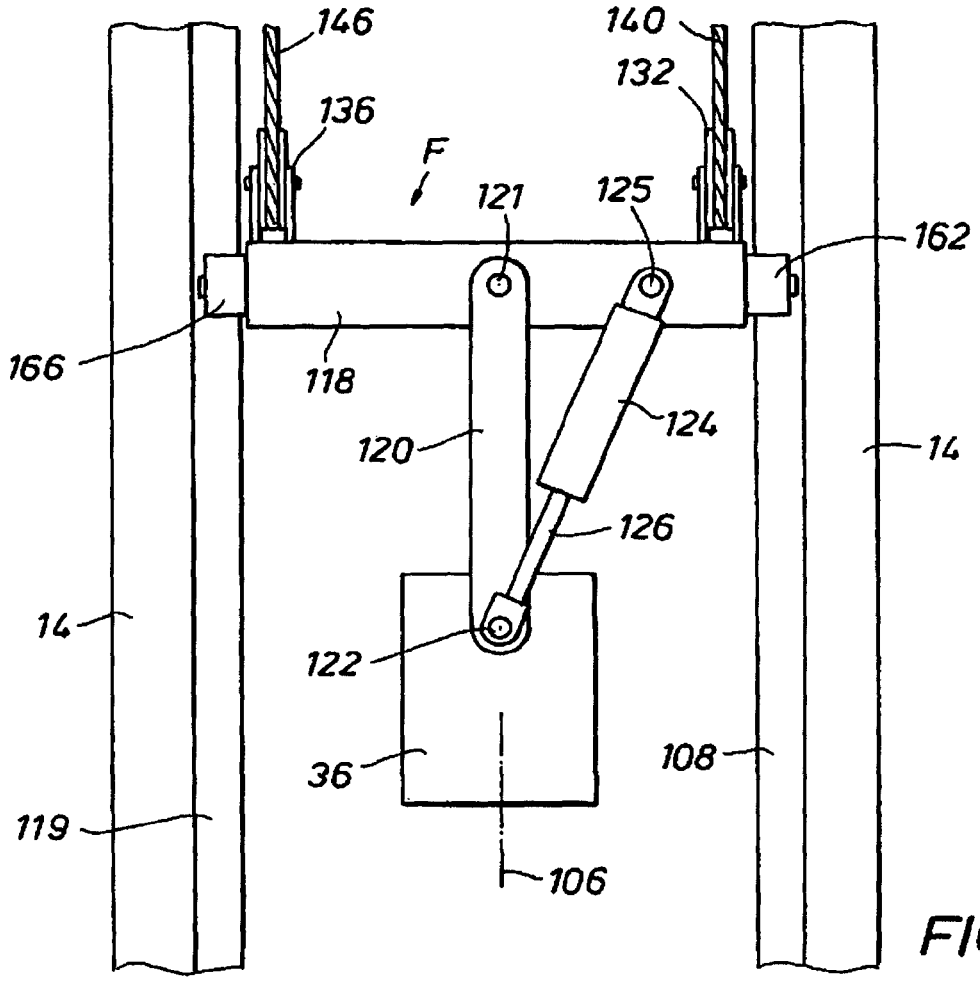
FIG. 11 is an elevational view of a top drive-split block arrangement shown in FIG. 10.
Figure 10:
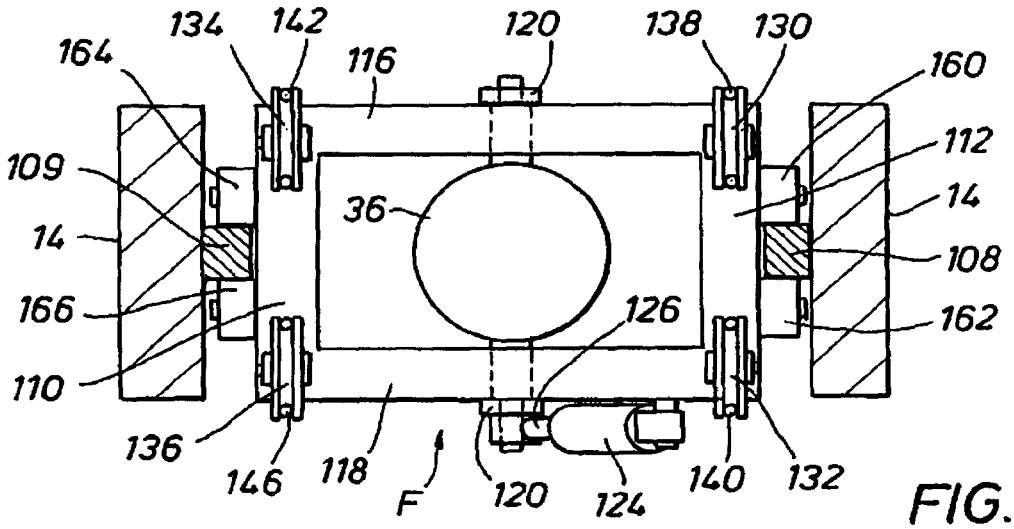
FIG. 10 shows a top, detailed view of a split block arrangement for carrying the top drive.

As shown in FIGS. 10 and 11, top drive 36 is suspended below frame F so as to be positioned generally centrally between side frame members 112 and 114, i.e., in a position generally in line with the wellbore axis 106.

Figure 13:
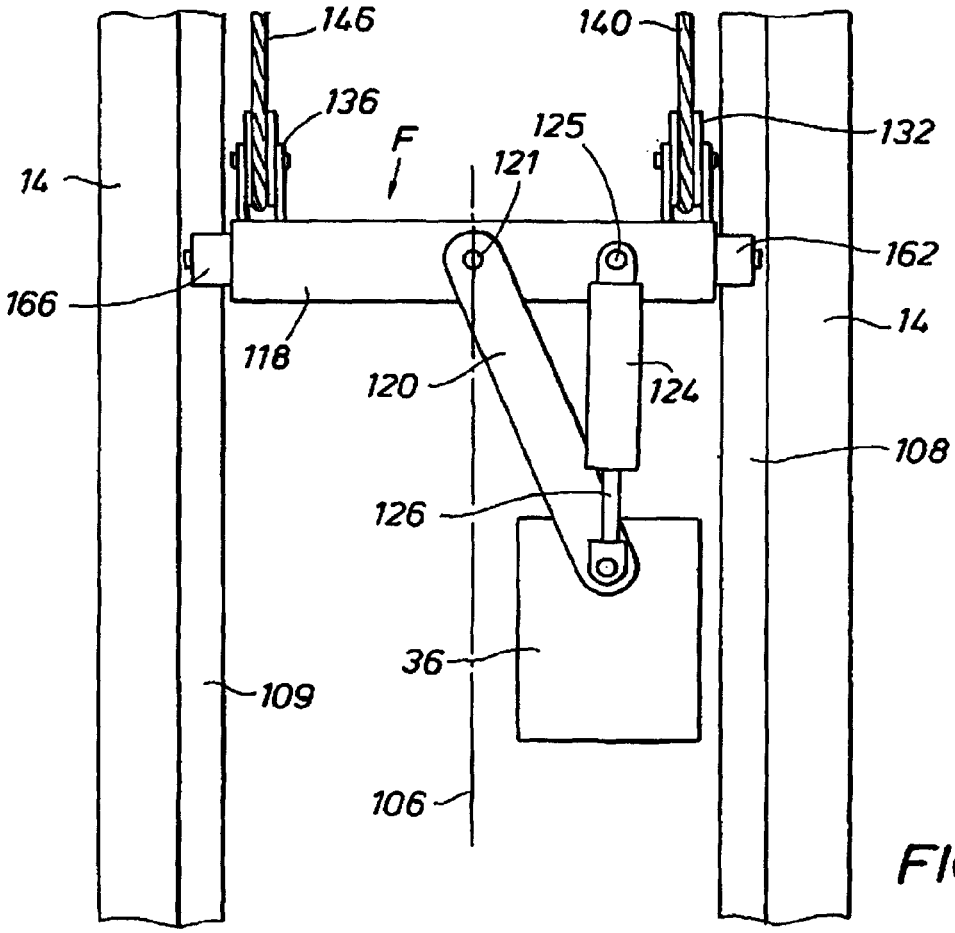
FIG. 13 is an elevational view of the arrangement shown in FIG. 12.
Figure 12:
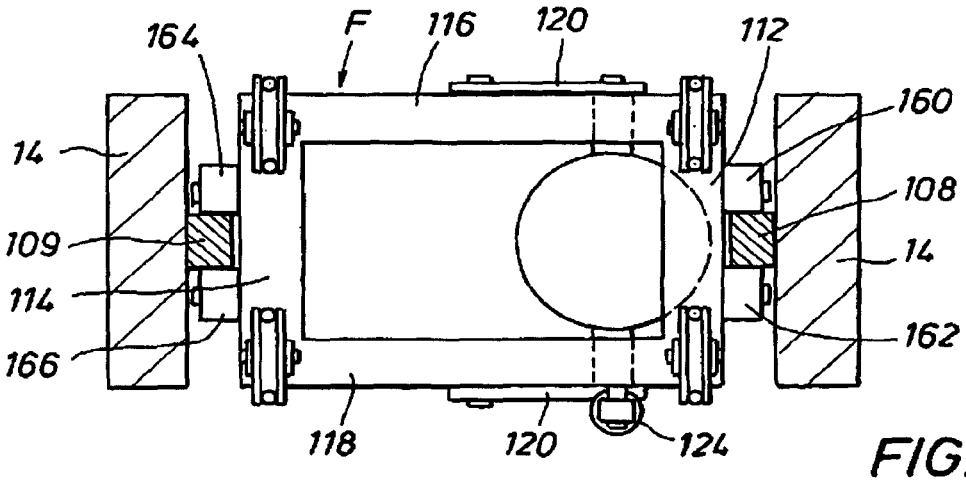
FIG. 12 is a top plan view, similar to FIG. 10 showing how the top drive can be moved laterally relative to the mast.

Referring now to FIGS. 12 and 13, the top drive 36 is shown as being displaced laterally off of the axis of the wellbore 106. To accomplish this, hydraulic piston-cylinder assembly 124 is activated to retract piston 126 which results in bail 120 pivoting around pivot point 121 moving top drive 36 toward track 108. Piston-cylinder assembly 124 can be hydraulic, pneumatic and it will be appreciated that any number of mechanisms can be used to move bail 120 and hence top drive 36 between the positions shown in FIGS. 11 and 13, i.e., from a position where top drive 36 is generally over center of the axis 106 of the wellbore to a position, as shown in FIG. 13, where it is moved laterally with respect to the axis 106. While the use of only one piston-cylinder assembly 124 is shown, as a practical matter two such assemblies would be used, one being attached to cross member 118 as shown, the other being attached to cross member 116. It will be apparent that piston-cylinder assembly 124 can be attached to frame F on the side nearest track 109 such that top drive 36 would now be moved to the left of wellbore axis 106 as viewed in FIG. 13. The arrangement shown in FIGS. 11 and 13 is as seen from the V-door side of the drilling rig (see FIG. 3). Although perhaps somewhat more complicated, an arrangement similar to that shown in FIGS. 11-13 could be used to move the top drive laterally either towards the V-door or towards the trailer upon which spool 28 is mounted.

As thus seen from the description above, the apparatus of the present invention can be used in a manner wherein only the top drive is operative, the coiled tubing injector being positioned, for example, at a point above the top drive, e.g., at the top of the mast adjacent the crown and being inoperative. Alternatively, the top drive can be moved to a lowered position on the mast, e.g., at or near the rotary table with the coiled tubing injector being carried by the top drive, the coiled tubing injector continuously injecting tubing into the earth borehole to perform a variety of operations. In this latter mode, the top drive is essentially inoperative save for the fact that it carries the coiled tubing injector and can still serve as an elevator for the coiled tubing injector. In any event all in embodiments, the coiled tubing injector, the top drive and the rotary table are on axes that are substantially coincident or can be made coincident with the wellbore.

The word "base" or "substructure" as used herein is intended to mean any structure, be it portable or fixed, whether on land or offshore, to which the mast can be fixedly, pivotally or removably attached, which will support the mast and the attendant equipment used in the apparatus of the present invention, including the coiled tubing spool, attendant motors, winches or draw works, and any other equipment commonly used either with (a) coiled tubing injectors, or (b) top drives.

The apparatus of the present invention can be used to accomplish numerous different earth borehole operations. In the case of employing the coiled tubing injector, the apparatus can be used to drill using downhole mud motors, such drilling being both directional and straight hole. Additionally, coiled tubing can be used in various completion operations such as fracturing; acidizing; cleanouts; fishing operations; using coiled tubing as a velocity string, etc. The coiled tubing can also be run as production tubing. With respect to typical top drive operations, conventional drilling can be done, casing can be run, and completion operations as described above with respect of coiled tubing can also be accomplished. Additionally, the top drive can be used to run conventional production tubing.

In general, the apparatus of the present invention permits every earth borehole operation that can be done in oil and gas well drilling using either a top drive or a coiled tubing unit.

A distinct advantage of the apparatus of the present invention when compared with prior art, so-called universal systems such as disclosed in U.S. Publication 2004/0206551, is the ability to perform simultaneous operations with both the coiled tubing injector and the top drive. In this regard, in the prior art universal systems it is necessary, when using the top drive, to move the coiled tubing injector laterally out of alignment from the borehole and vice versa. With the apparatus of the present invention, since the coiled tubing injector remains positioned in line with the top drive and the borehole, in the event, for example, that operations with the top drive are being performed, e.g., running casing, and the casing sticks, using the apparatus of the present invention, coiled tubing can be run down through the top drive into the casing to assist in freeing the casing. It will be apparent that other situations can occur where it would be necessary to quickly inject coiled tubing down through the top drive and through a tubular string or other downhole component being manipulated by the top drive to effect some downhole operation. This, of course, cannot be accomplished with the prior art, so-called universal systems since, as noted, only one of the top drive or the coiled tubing injector can be positioned in alignment with the wellbore at any given time.

In the above description, the word "mounted" has been used with respect to the interrelationship between various components of the apparatus as, for example, the relation of the mast to the top drive and/or the coiled tubing injector. It is to be understood that, as used herein, the word "mounted", or variants thereof, in addition to its usual meaning, is intended to include meanings such as "positioned", "positioned on", "carried by", "carried on", "carried", "sitting on", "resting on", or any other similar term. In other words, the word "mounted", or variants thereof, is not necessarily limited to meaning "affixed", "affixed to", "attached to", "attached", "secured to" or other words or phrases carrying a similar meaning. Thus, for example, references in the description above to the coiled tubing injector being "mounted on the mast" are intended to include situations wherein the coiled tubing injector is positioned adjacent to the mast or positioned relative to the mast, all with the goal of achieving a scenario wherein the coiled tubing injector, when injecting coiled tubing, is above the top drive such that coiled tubing from the tubing injector can pass through the opening in the top drive from a position above the top drive.

It will be understood, that the present invention is not limited to the use in oilfield operations but can be used in water well drilling, mining operations, in drilling injection wells, etc. Also, as noted above, the apparatus of the present invention is not limited to land earth borehole operations but can be used, as well, on offshore drilling and production platforms.

The foregoing description and examples illustrate selected embodiments of the present invention. In light thereof, variations and modifications will be suggested to one skilled in the art, all of which are in the spirit and purview of this invention.

What is claimed is:

1. An apparatus for performing earth borehole operations comprising:

a base;

a mast mounted in said base, said mast having first and second mast tracks, and first and second spur tracks connected to said first and second mast tracks, respectively;

a coiled tubing injector mounted in said mast for longitudinal movement therealong;

a top drive, longitudinally movable along said mast, said top drive having a first position in said mast over a wellhead center, and a second position laterally displaced from said wellhead center, said top drive being movable to said second position on said first and second spur tracks, said first and second spur tracks extending downwardly and transversely to said first and second mast tracks, respectively, such that said top drive can simultaneously be moved downwardly and transversely to said mast tracks.

2. The apparatus of claim 1, wherein said mast comprises first and second spaced frame members, said first and second mast tracks extending longitudinally along said first and second spaced frame members, respectively, said top drive, when in said first position, being movable along said first and second mast tracks.

3. The apparatus of claim 1, further including a switching mechanism to switch said top drive from said mast tracks to said spur tracks.

4. The apparatus of claim 1, wherein said top drive is carried by a frame, said frame having a first side and a second side, said first side carrying a first assembly movably engaging said first mast track, said second side carrying a second assembly movably engaging said second mast track whereby said frame can move longitudinally along said mast tracks.

* * * * *